US009909319B1

(12) United States Patent
Voress

(10) Patent No.: US 9,909,319 B1
(45) Date of Patent: Mar. 6, 2018

(54) GUTTER COVER

(71) Applicant: Eric Voress, Sidney, OH (US)

(72) Inventor: Eric Voress, Sidney, OH (US)

( * ) Notice: Subject to any disclaimer, the term of this patent is extended or adjusted under 35 U.S.C. 154(b) by 0 days.

(21) Appl. No.: 15/478,967

(22) Filed: Apr. 4, 2017

(51) Int. Cl.

| | |
|---|---|
| ***E04D 13/00*** | (2006.01) |
| ***E04D 13/076*** | (2006.01) |
| ***E04D 13/064*** | (2006.01) |
| *E04D 13/04* | (2006.01) |
| *E04D 13/10* | (2006.01) |

(52) U.S. Cl.
CPC ..... *E04D 13/076* (2013.01); *E04D 13/064* (2013.01); *E04D 13/04* (2013.01); *E04D 13/0762* (2013.01); *E04D 13/103* (2013.01)

(58) Field of Classification Search
CPC . E04D 13/076; E04D 13/103; E04D 13/0762; E04D 13/04; E04D 13/0418
USPC ..... 52/12, 11, 13, 15, 97, 302.3
See application file for complete search history.

(56) References Cited

U.S. PATENT DOCUMENTS

| | | | | |
|---|---|---|---|---|
| 3,351,206 | A * | 11/1967 | Wennerstrom | E04D 13/076 210/474 |
| 4,497,146 | A | 2/1985 | Demartini | |
| 5,459,965 | A | 10/1995 | Meckstroth | |
| 5,557,891 | A * | 9/1996 | Albracht | E04D 13/076 52/11 |
| 5,640,810 | A | 6/1997 | Pietersen | |
| 5,836,344 | A * | 11/1998 | Hovi, Sr. | E04D 13/103 137/338 |
| 6,016,631 | A | 1/2000 | Lowrie, III | |
| 6,073,398 | A | 6/2000 | Williams | |
| 6,098,345 | A | 8/2000 | Demartini et al. | |
| 6,367,743 | B1 | 4/2002 | Iannelli | |
| 6,412,228 | B1 | 7/2002 | Meckstroth | |
| 6,672,012 | B2 | 1/2004 | Bahroos et al. | |
| 6,732,477 | B1 | 5/2004 | Richard | |
| 6,883,760 | B2 | 4/2005 | Seise, Jr. | |
| 6,904,718 | B2 | 6/2005 | Fox | |
| 6,968,651 | B2 | 11/2005 | Bergeron | |
| 7,104,012 | B1 | 9/2006 | Bayram | |
| 8,099,908 | B2 * | 1/2012 | Brochu | E04D 13/076 248/48.1 |
| 8,434,269 | B1 * | 5/2013 | Brochu | E04D 13/076 52/12 |
| 2005/0247611 | A1 * | 11/2005 | Groth | E04D 13/076 210/162 |
| 2006/0196124 | A1 * | 9/2006 | Bachman | E04D 13/076 52/12 |
| 2008/0010906 | A1 * | 1/2008 | Brochu | E04D 13/076 52/12 |

(Continued)

OTHER PUBLICATIONS

PERMAFLOW, Gutter Protection Products, one page, 2017.
Why the Waterfall?, Gutter Protection Products, one page, 2017.

*Primary Examiner* — Chi Q Nguyen
(74) *Attorney, Agent, or Firm* — Standley Law Group LLP

(57) ABSTRACT

A gutter cover has a lip where fasteners attach the cover to a structure. An upper cover extends at a downward angle away from the structure while a folded section extends and a downward angle towards the structure. A covering section extends substantially parallel to and spaced apart from the folded section back towards the front of the gutter and has a number of apertures therein for filtering debris. A filtering mesh is located between the covering section and the folded section and may also filter debris. A connecting lip secures cover to the front of the gutter.

19 Claims, 22 Drawing Sheets

(56) References Cited

U.S. PATENT DOCUMENTS

| | | | | |
|---|---|---|---|---|
| 2009/0019786 | A1* | 1/2009 | Bachman | E04D 13/076<br>52/12 |
| 2009/0108144 | A1* | 4/2009 | Brochu | E04D 13/076<br>248/48.1 |
| 2011/0041414 | A1* | 2/2011 | Bell | E04D 13/076<br>52/12 |
| 2011/0185641 | A1* | 8/2011 | Snell | E04D 13/076<br>52/12 |
| 2017/0204611 | A1* | 7/2017 | Brochu | E04D 13/064 |

* cited by examiner

GUTTER COVER

CROSS-REFERENCE TO RELATED APPLICATION

This application makes no priority claim.

TECHNICAL FIELD

Exemplary embodiments of the present invention relate generally to an apparatus and system for covering a gutter.

BACKGROUND AND SUMMARY OF THE INVENTION

Homeowners or other individuals charged with the maintained of various structures have long resented the accumulation of debris in their gutters. Such accumulation, often occurring in the fall due to the annual dropping of leaves, can impede or block the flow of water through the gutter system. Such blockages reduce or completely destroy the ability of the gutter to effectively remove water from the house or other structure. In such cases, water may backup in the gutter and overflow, which can cause damage to the gutters themselves, the structure, and to the surrounding property.

Often, manual cleaning is required to clear the gutters. This process is time consuming, unpleasant, and labor intensive. Further, as gutters are generally located just below the roof at an elevated position, ladders or other equipment are required to access and clean the gutters. This can bring rise to fall risks and other related injuries. Further still, due to the narrow shape of the gutters, special tools are sometimes required to effectively clear out such debris.

Known gutter covers exist that cover the opening of a gutter such that water is permitted to enter the gutter while leaves and other major debris are prevented. These known gutter covers do not effectively prevent minor debris from entering the gutter. Even minor debris can cause damage to the gutter and can build up and cause blockages in the gutter system. Furthermore, such known gutter covers often fail to provide adequate and efficient means for water to enter the gutter while also encouraging leaves and other debris to travel off the gutter. Therefore, what is needed is a gutter cover which is capable of preventing even minor debris from entering the gutter while also providing adequate and efficient means for water to enter the gutter while encouraging leaves and other debris to travel off the gutter.

The present invention is a gutter cover capable of preventing major and minor debris from entering the gutter while also providing adequate and efficient means for water to enter the gutter while simultaneously encouraging leaves and other debris to travel off the gutter. The gutter cover may comprise an upper cover that may extend a distance away from structure. Preferably, the upper cover extends at a downward angle. A lip may extend vertically from the upper cover and may be configured to receive fasteners such that the gutter cover can be mounted to the structure. A folded section may extend at a downward angle from the other end of the upper cover in the reverse direction a distance towards the structure.

A covering section may extend from the end of the folded section back towards the front edge of the gutter. The covering section may extend substantially parallel to the folded section and be spaced apart therefrom. The covering section may comprise a number of apertures located therein which are configured to let water pass therethrough. The space between the folded section and the covering section may be configured to receive a filtering mesh. The filtering mesh may further serve to keep smaller debris out of the gutters that would otherwise be able to enter the apertures. A connecting lip may extend from the end of the covering section and may be configured to be secured against the outer face of the gutter.

BRIEF DESCRIPTION OF THE DRAWINGS

In addition to the features mentioned above, other aspects of the present invention will be readily apparent from the following descriptions of the drawings and exemplary embodiments, wherein like reference numerals across the several views refer to identical or equivalent features, and wherein.

DETAILED DESCRIPTION OF EXEMPLARY EMBODIMENT(S)

Various embodiments of the present invention will now be described in detail with reference to the accompanying drawings. In the following description, specific details such as detailed configuration and components are merely provided to assist the overall understanding of these embodiments of the present invention. Therefore, it should be apparent to those skilled in the art that various changes and modifications of the embodiments described herein can be made without departing from the scope and spirit of the present invention. In addition, descriptions of well-known functions and constructions are omitted for clarity and conciseness.

Figure 1:
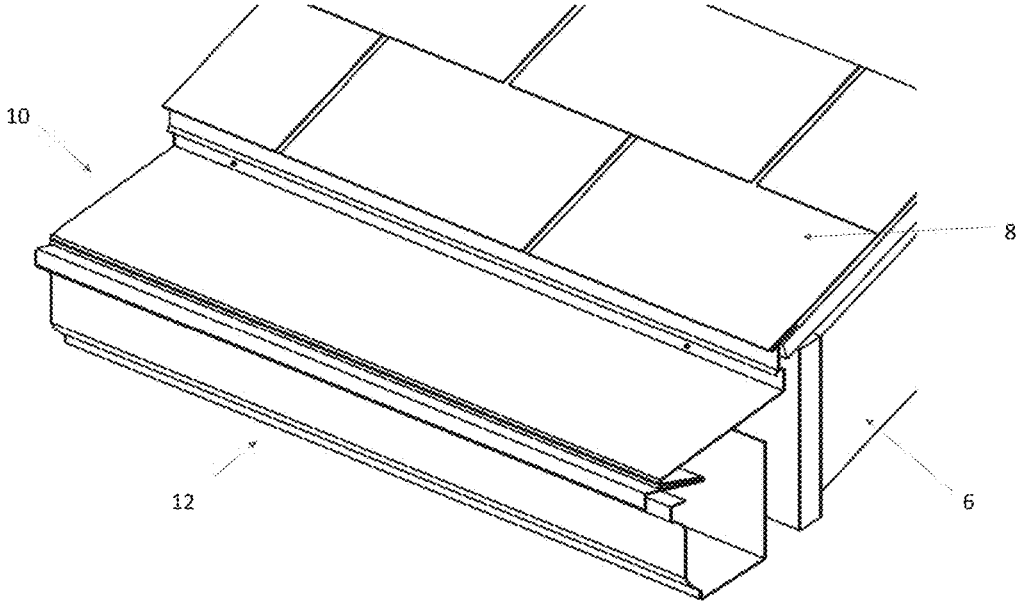
FIG. 1 is a perspective sectional view of an exemplary embodiment of the present invention illustrated as installed on a gutter.
Figure 2:
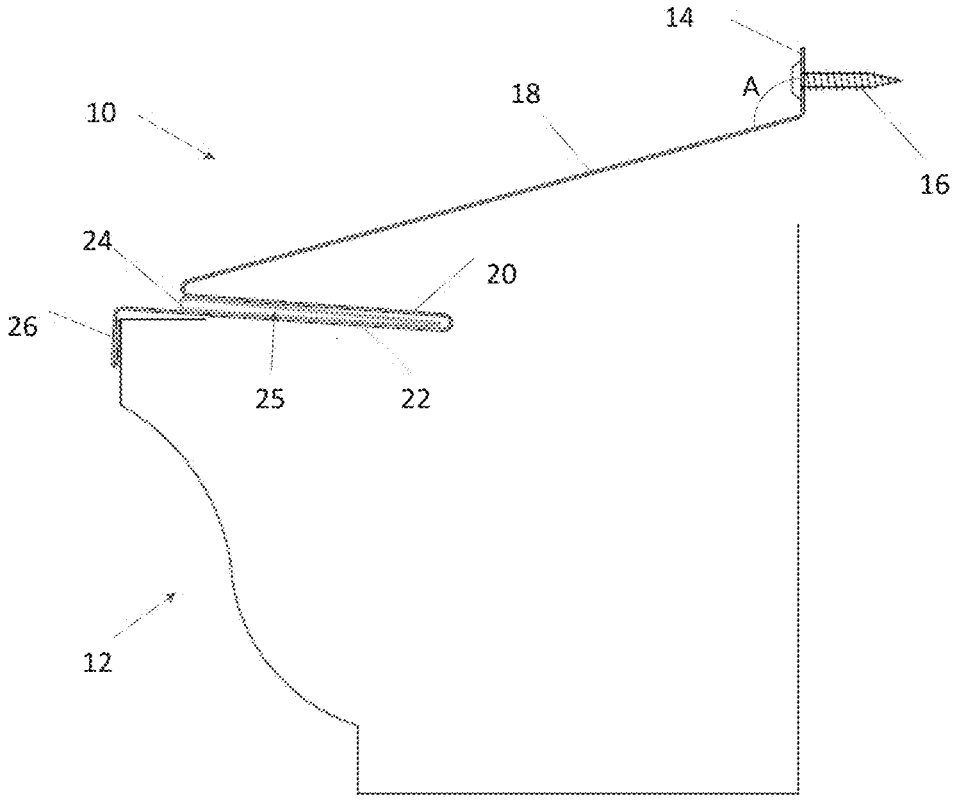
FIG. 2 is a right side sectional view of the device of FIG. 1 pictured without the structure to show additional features.
Figure 3:
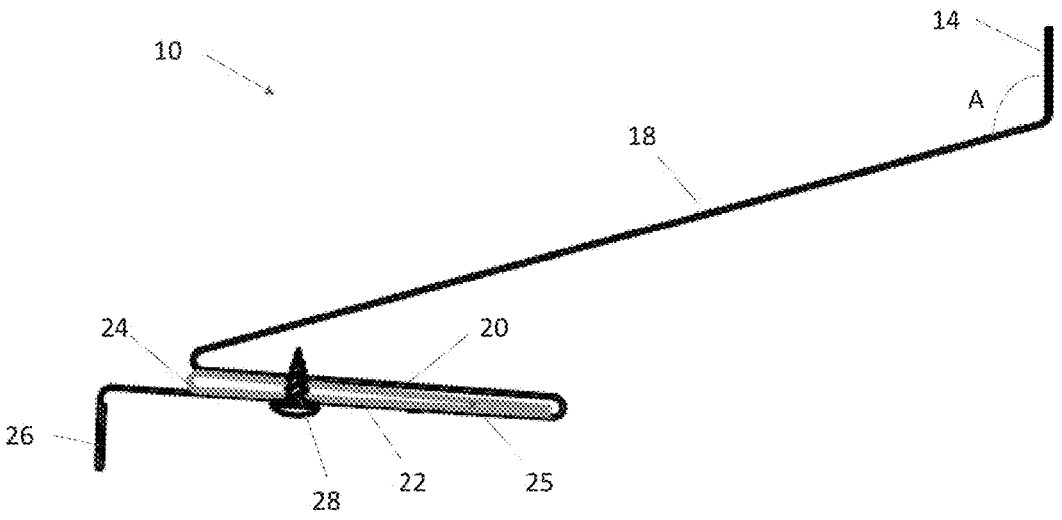
FIG. 3 is a right side sectional view of the embodiment of FIG. 1 pictured without the structure and gutter to show additional features.
Figure 4:
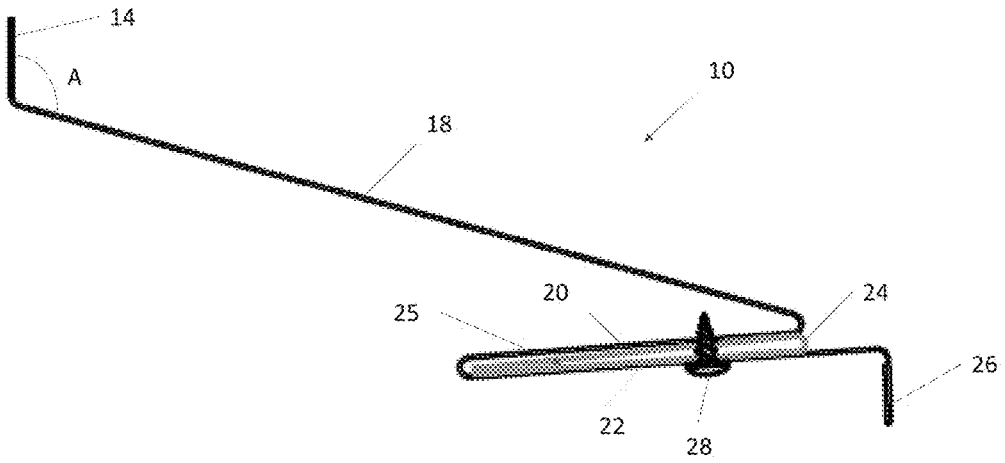
FIG. 4 is a left side sectional view of the embodiment of FIG. 1.
Figure 5:
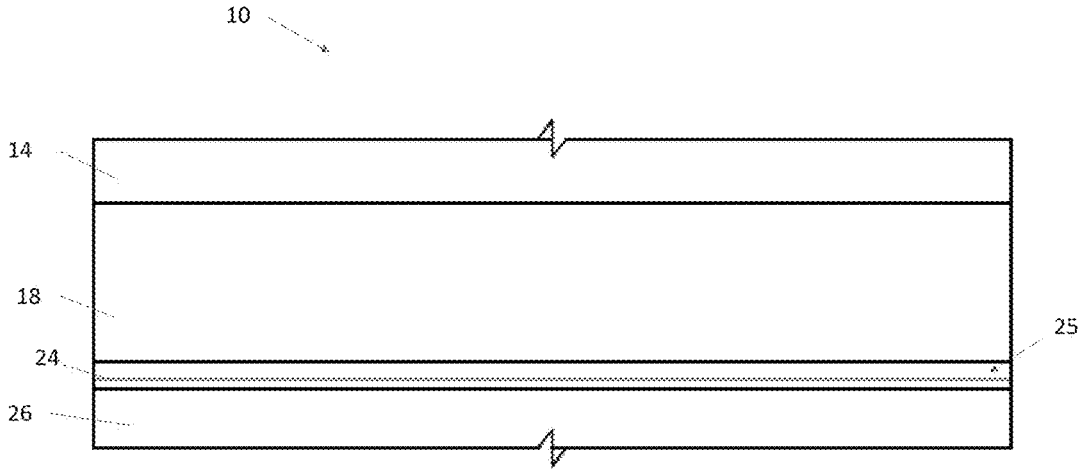
FIG. 5 is a front view of the embodiment of FIG. 1.
Figure 6:
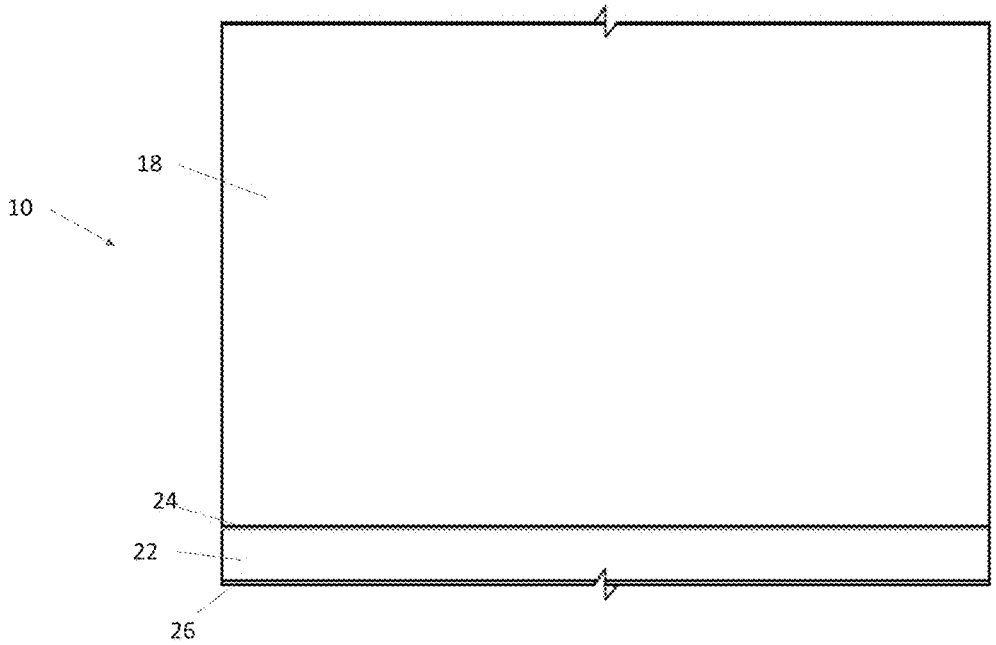
FIG. 6 is a top view of the embodiment of FIG. 1.
Figure 7:
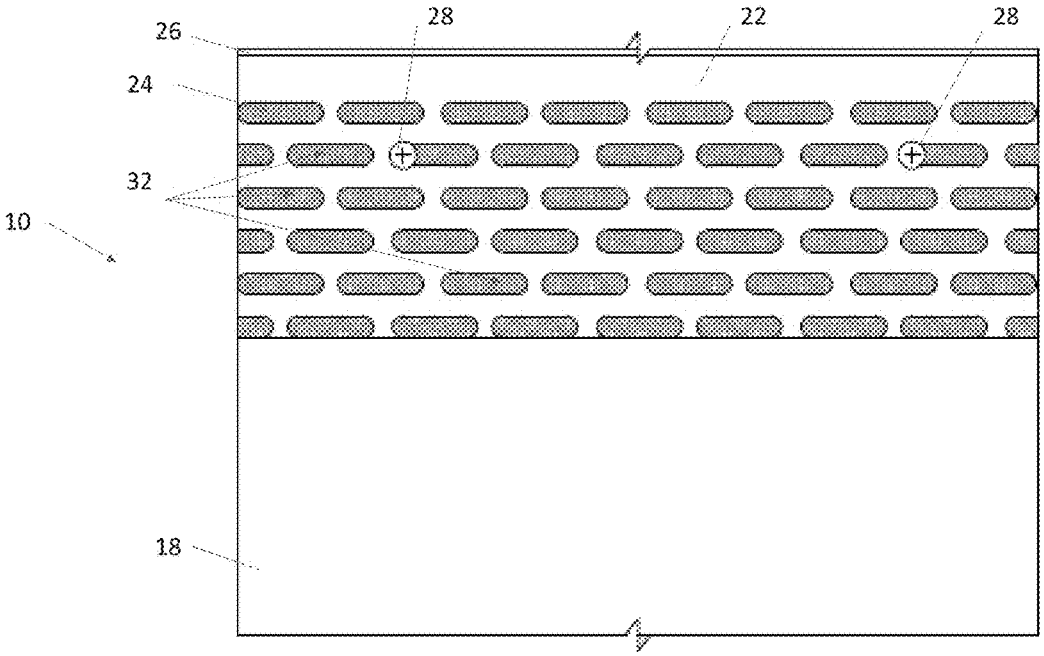
FIG. 7 is a bottom view of the embodiment of FIG. 1.

FIG. 1 though FIG. 7 illustrate a first embodiment of a gutter cover 10. The gutter cover 10 may be configured to be mounted atop a gutter 12. The gutter 12 may be attached to a home or other structure 6, preferable just below the roof 8 of said structure 6. The gutter cover 10 may comprise an attachment lip 14 that extends vertically such that the inner surface of the attachment lip 14 may be placed substantially flush with the outer wall of the structure 6. In exemplary embodiments of the present invention, the attachment lip 14 comprises a number of holes, perforations, weakened regions, or the like configured to receive a fastener 16 that connects the attachment lip 14 to the structure 6. Such fasteners 16 may include, but are not limited to a threaded fastener, nail, staple, or the like. In other exemplary embodiments, no such holes and provided and the fastener 16 may simply by driven through the attachment lip 14 to the structure 6. In such embodiments, the attachment lip 14 may comprise a number of markers or depressions located on the outer surface thereof to provide suggested alignment for said fasteners 16. In still other exemplary embodiments, the lip 14 may be secured to the structure by way of an adhesive.

An upper cover 18 may extend at a downward angle from the attachment lip 14 such that the angle A between the outer surface of the attachment lip 14 and outer surface of the upper cover 18 is between 90 and 180 degrees. Regardless of the angle A, the upper cover 18 may extend a distance, preferably to a point in close proximity with the upper edge of the gutter 12. The angle A may be selected to optimize the flow of water or other precipitation down the upper cover 18 while also encouraging debris to be removed from the upper cover 18 by gravity, wind, water flow, some combination thereof, or the like.

A reversing section shaped as an elongated U defining an upper and a lower portion may extend in the opposite direction of the upper cover 18. Stated another way, the reversing section may extend back towards the structure 6. Preferably, the reversing section extends at a slightly downward angle relative to the ground so as to encourage water to flow in a reversed direction relative to the flow along the upper cover 18. In this way, debris may be encouraged to continue to travel off the roof 8, while water is encouraged to travel into the reversing section. In exemplary embodiments, the reversing section may comprise a folded section 20 located substantially in parallel with and spaced apart from a covering section 22.

The space between the folded section 20 and the covering section 22 may define a gap 25. One or more spacers 28 may extend between the folded section 20 and the covering section 22. The spacer 28 may be configured to hold the folded section 20 spaced apart from the covering section 22 to define the gap 25. In exemplary embodiments, the spacer 28 is a threaded fastener, though any type or size of spacer is contemplated. The spacers 28 may be spaced apart along the reversing section and positioned in any arrangement. In other exemplary embodiments, the folded section 20 and the covering section 22 may be clinched together and the spacers 28 may not be required.

The folded section 20 may be connected to an end of the upper cover 18 such that the upper cover 18 and/or the folded section 20 is curved before extending back towards the structure 6. Likewise, the covering section 22 may extend from the end of the folded section 20 back towards a front edge of the gutter 12 such that the covering section 22 and/or the folded section 20 is curved before extending back towards the front edge of the gutter 12. As the folded section 20 may extend at a downward angle towards the structure, the covering section 22 may extend at an upward angle towards the front edge of the gutter 12.

The covering section 22 may comprise a number of apertures 32 located therein. The apertures 32 may be configured to allow water to pass into the gutter 12 while preventing major debris from entering the gutter 12. The apertures 32 may be so configured by their size, shape, and position. In exemplary embodiments, the apertures 32 are spaced apart at regular intervals along the majority of the covering section, though it is contemplated that the apertures 32 may cover any portion of the covering section 22 and may be located randomly or in any pattern. Further, while the apertures 32 may be substantially circular or oval shaped, it is contemplated that the aperture 32 may be of any size or shape. The apertures 32 may be the same size and shape or may be of different sizes and shapes along the covering section 22. The apertures 32 may be stamped, pressed, drilled, or otherwise formed into the covering section 22 at any point during the manufacturing process. In other exemplary embodiments, the apertures 32 may be integrally formed with the covering section 22.

In exemplary embodiments, the covering section 22 may extend substantially in parallel with the folded section 20 but is spaced apart therefrom to form the gap 25. The gap 25 may be sized and configured to receive a filtering mesh 24 in the space between the covering section 22 and the folded section 20. The filtering mesh 24 may be configured to filter out smaller debris from the gutters 12 that would otherwise be able to enter the apertures 32 and the gutter 12. Preferably the filtering mesh 24 is a comprised of wire, though any material is contemplated, and may be received in a folded arrangement and may be size and configured to substantially fill the space between the covering section 22 and the folded section 20.

The covering section 22 preferably extends to or beyond the front edge of the gutter 12. It is contemplated that the portion of the covering section 22 which extends beyond the filtering mesh 24 may comprise a different slope than the rest of the covering section 22. For example, but not to serve as a limitation, said portion of the covering section 22 may be sloped upwards or may be level. A connecting lip 26 may extend vertically downward from the end of the covering section 22 such that it is flush with the outer face of the gutter 12 where it may be secured thereto. In exemplary embodiments, the connecting lip 26 is comprised of a resiliently deformable material and is formed at a slight inward angle relative to the outer face of the gutter 12 such that it is snugly fitted to and may provide pressure against, the outer surface of the gutter 12. The connecting lip 26 may comprise a doubled over section wherein the connecting lip 26 is folded over itself. This folded over section may provide added rigidity to enhance the snug fit and/or pressure against the outer surface of the gutter 12. In other exemplary embodiments, the connecting lip 26 may be similar to the attachment lip 14 in that it may serve as location for fasteners 16 to attach the connecting lip 26 to the gutter 12. In still other exemplary embodiments, the connecting lip 26 may be shaped to hook onto the gutter 12.

The gutter cover 10, including all components thereof, may be comprised to the same of different materials. In exemplary embodiments, the attachment lip 14, the upper cover 18, the folded section 20, the covering section 22, and the connecting lip 26 are comprised of a single material which is extruded, pressed, stamped, forged, or otherwise formed or manipulated into the desired shape. In exemplary embodiments, at least the upper cover 18 is comprised of a substantially water impermeable material. At least the upper cover 18 may further be comprised or a material having a low coefficient of friction. In exemplary embodiments, the gutter cover 10 is comprised or a metal or plastic. The filtering mesh 24 may be comprised of a metallic wire that forms a mesh, and the fasteners 16 may be comprised of metal.

Rainfall or other precipitation may fall on the roof 8. Under ideal conditions, that precipitation would travel along the roof 8 and into the gutter 12 where it can be safely carried away from the home. Under less than ideal conditions, debris may be received on the roof 8 or in the gutter 12 and may cause blockages in the gutter 12, which can cause damage to the structure 6 or surroundings. Precipitation and debris received on the roof 8 or gutter cover 10 is blocked from entering the gutter 12 by the upper cover 18. Due to the downward angle A the debris and precipitation is forced or encouraged to travel down the upper cover 18 by gravity and/or other external forces, such as but not limited to wind, water flow, or the like. Regardless, the precipitation may be forced or encouraged to travel backwards into the reversing section, through the filtering mesh 24 and the apertures 32 and into the gutter 12, while the debris is filtered and forced or encouraged to travel off the gutter 12.

Figure 8:
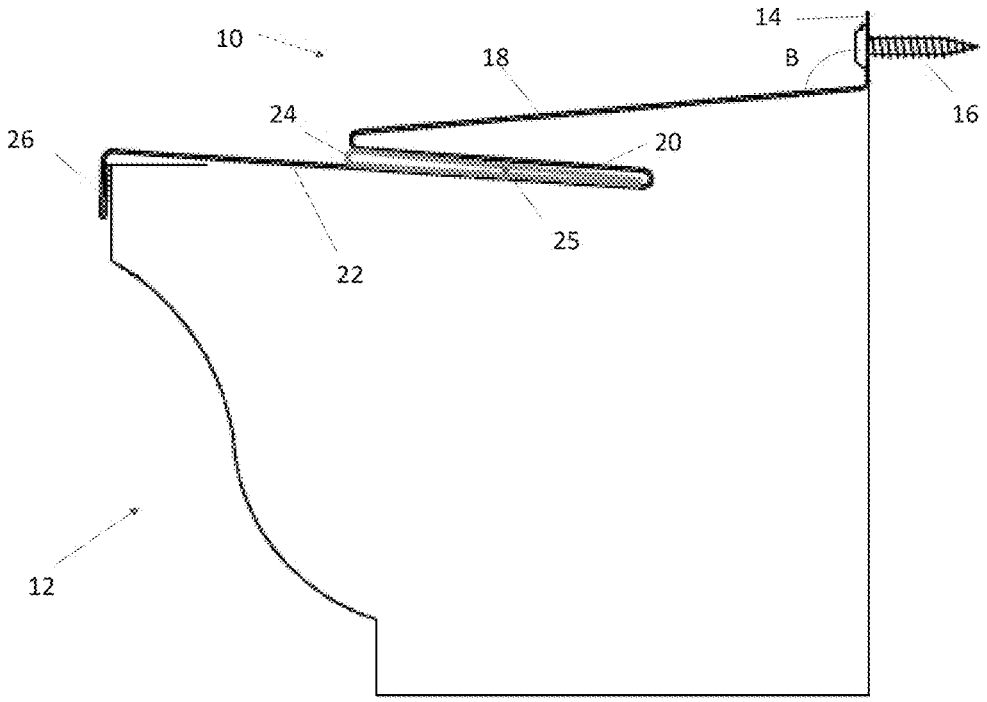
FIG. 8 is a right side sectional view of another exemplary embodiment of the present invention illustrated as installed on a gutter.
Figure 9:
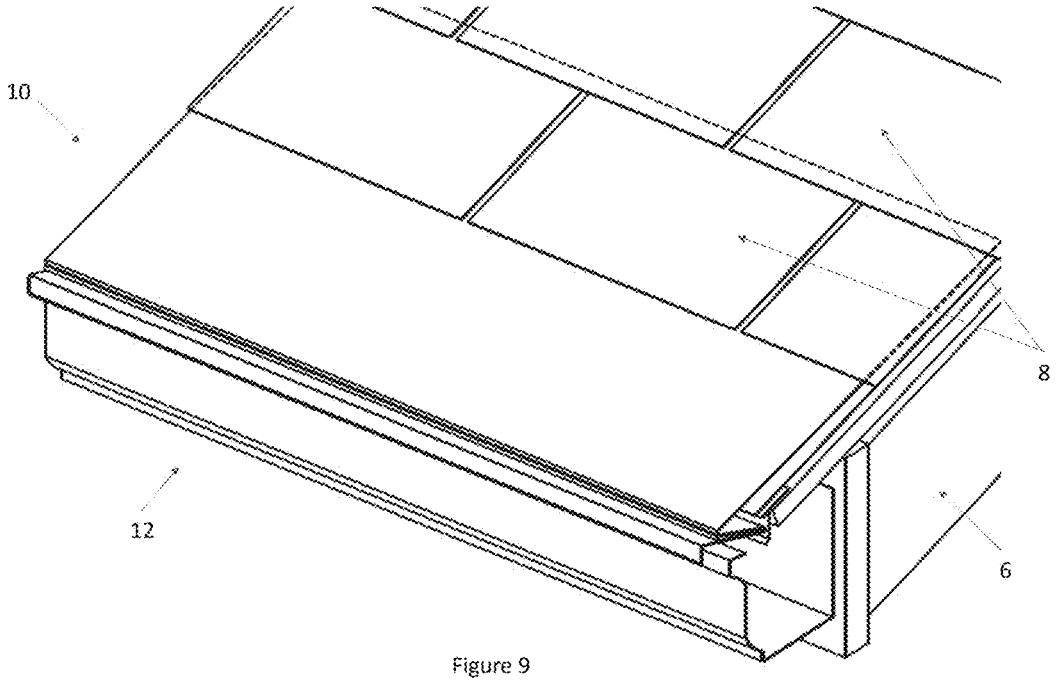
FIG. 9 is a perspective sectional view of another exemplary embodiment of the present invention illustrated as installed on a gutter.
Figure 10:
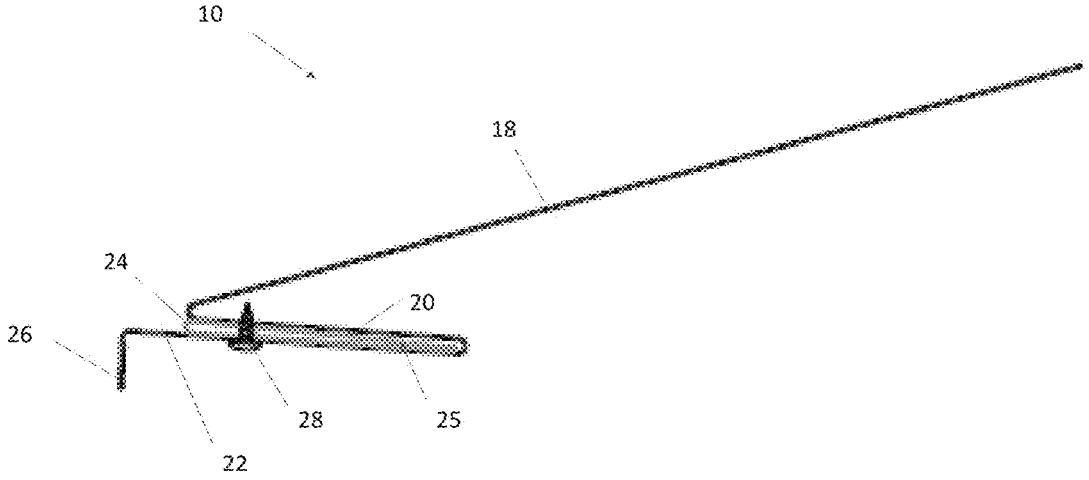
FIG. 10 is a right side sectional view of the embodiment of FIG. 9 pictured without the structure and gutter to show additional features.
Figure 11:
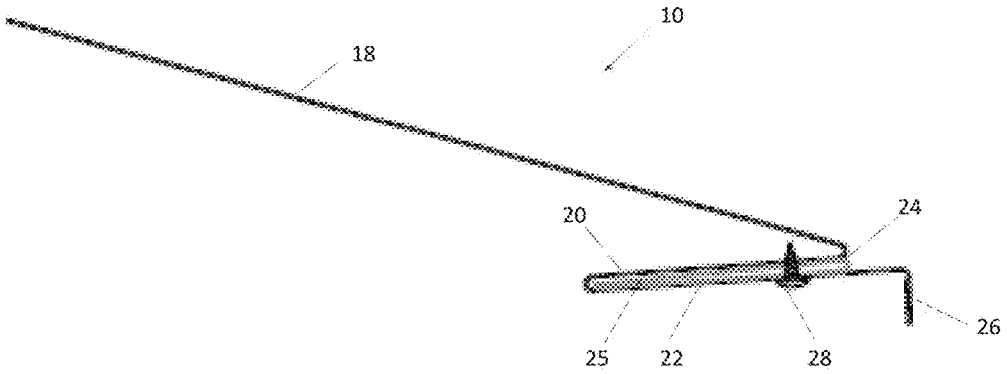
FIG. 11 is a left side sectional view of the embodiment of FIG. 9.
Figure 12:
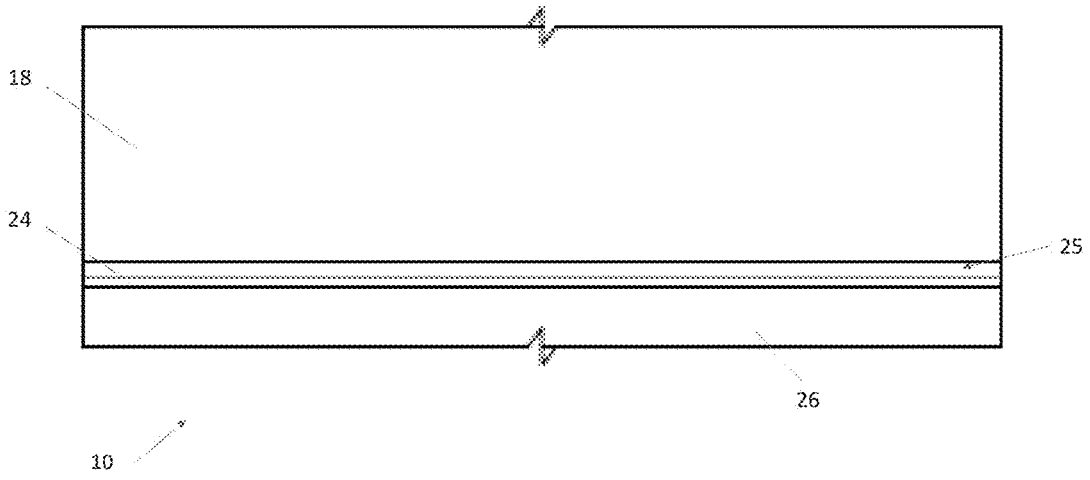
FIG. 12 is a front view of the embodiment of FIG. 9.
Figure 13:
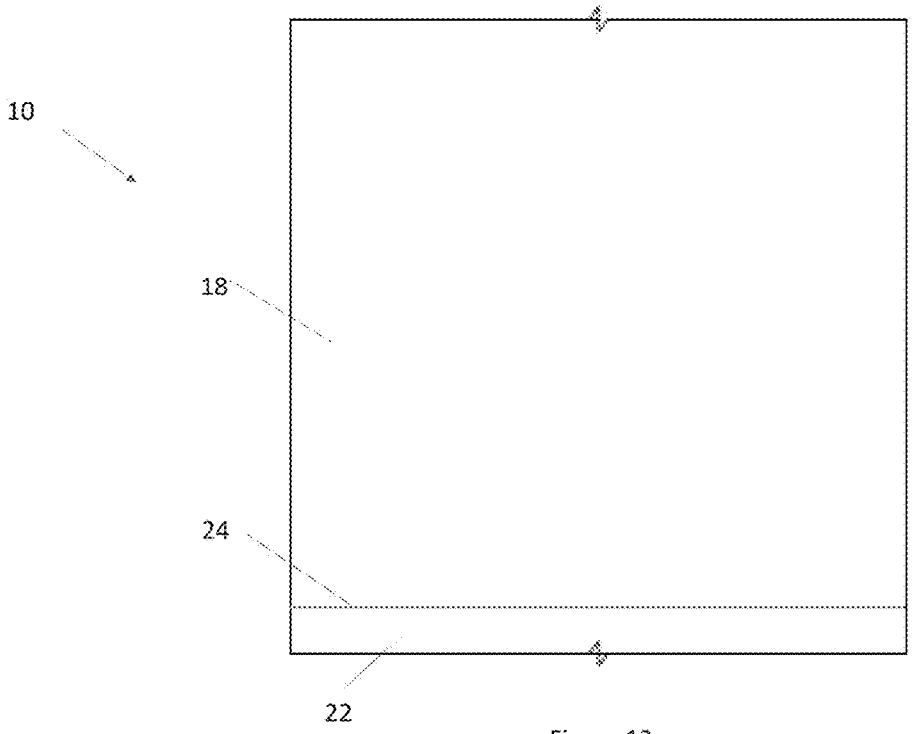
FIG. 13 is a top view of the embodiment of FIG. 9.
Figure 14:
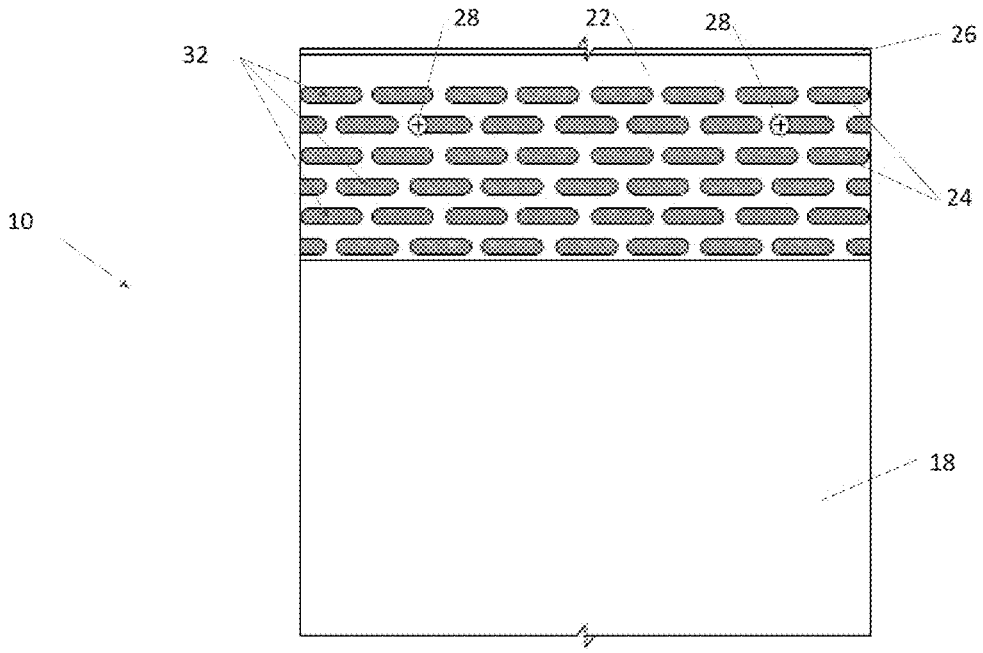
FIG. 14 is a bottom view of the embodiment of FIG. 9.
Figure 15:
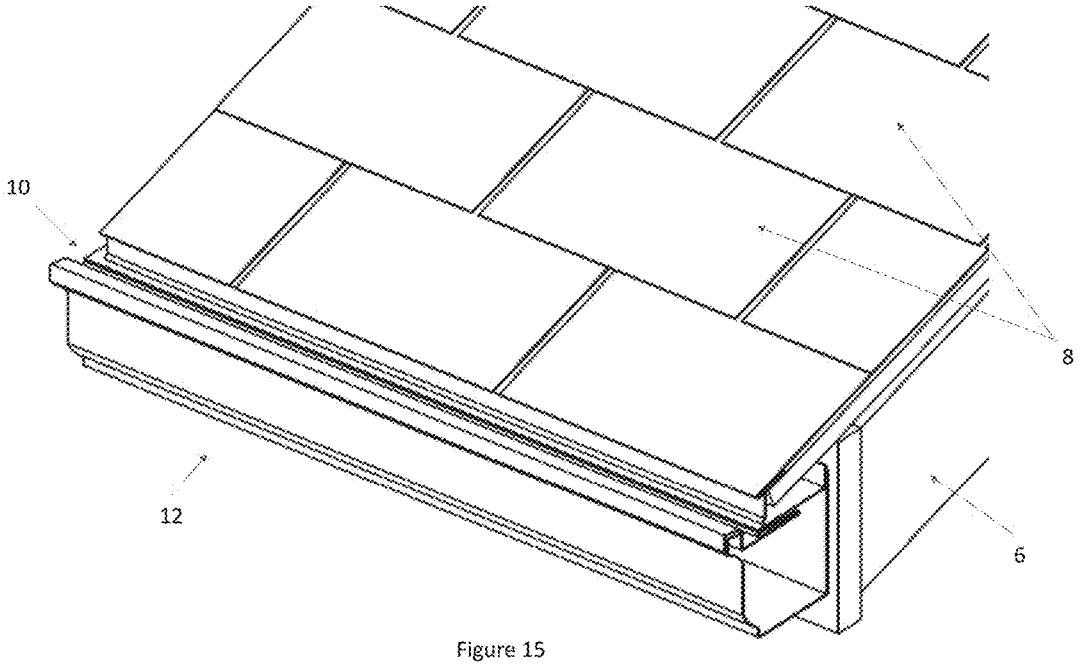
FIG. 15 is a perspective sectional view of another exemplary embodiment of the present invention illustrated as installed on a gutter.
Figure 16:
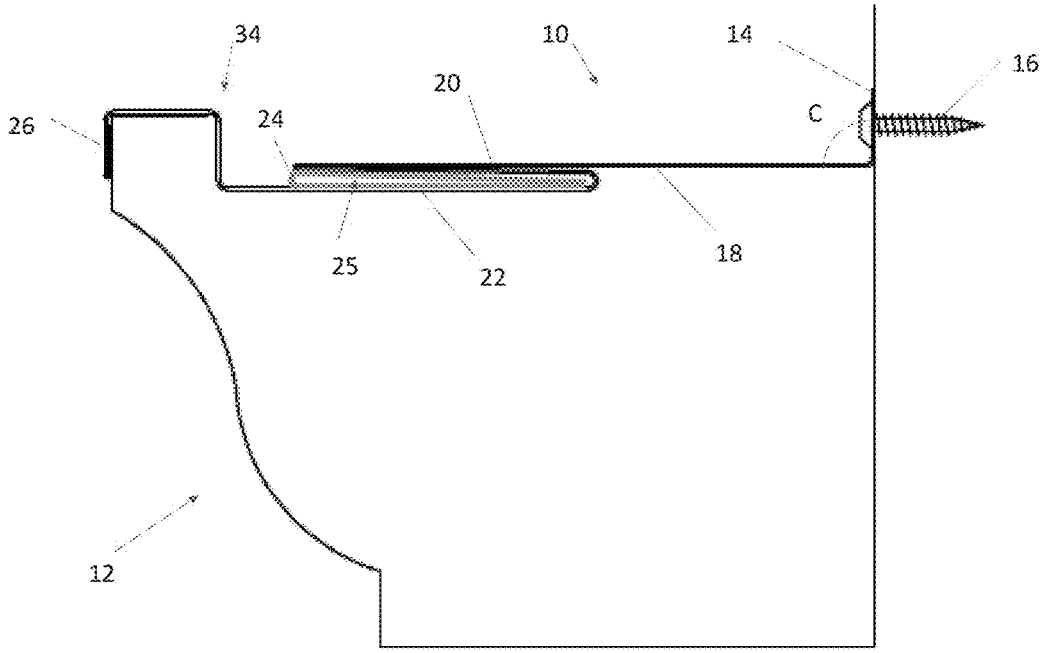
FIG. 16 is a right side sectional view of the embodiment of FIG. 15 pictured without the structure to show additional features.
Figure 17:
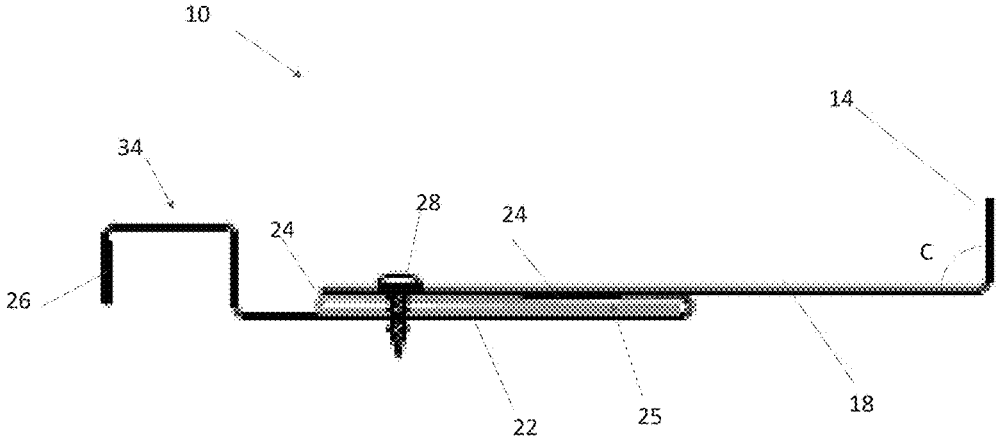
FIG. 17 is a right side sectional view of the device of FIG. 15 pictured without the structure and gutter to show additional features.
Figure 18:
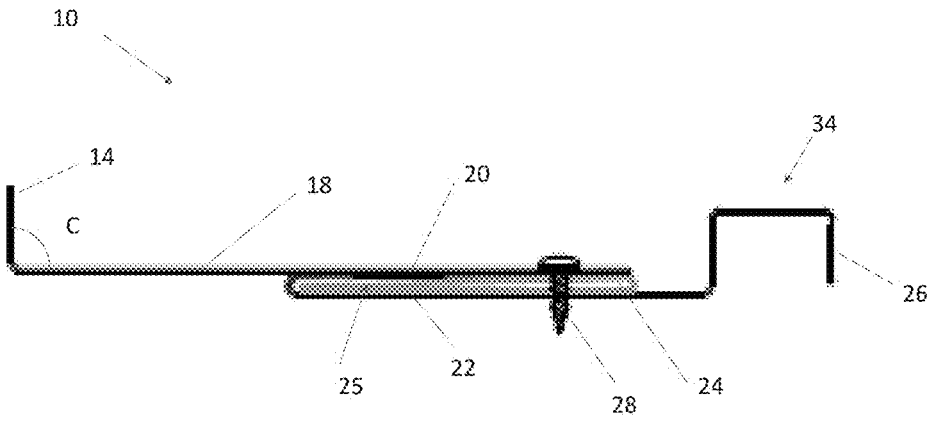
FIG. 18 is a left side sectional view of the embodiment of FIG. 15.
Figure 19:
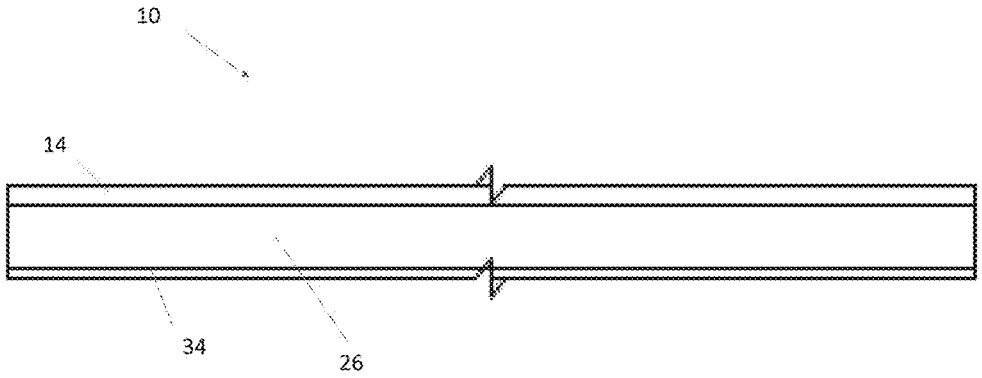
FIG. 19 is a front view of the embodiment of FIG. 15.
Figure 20:
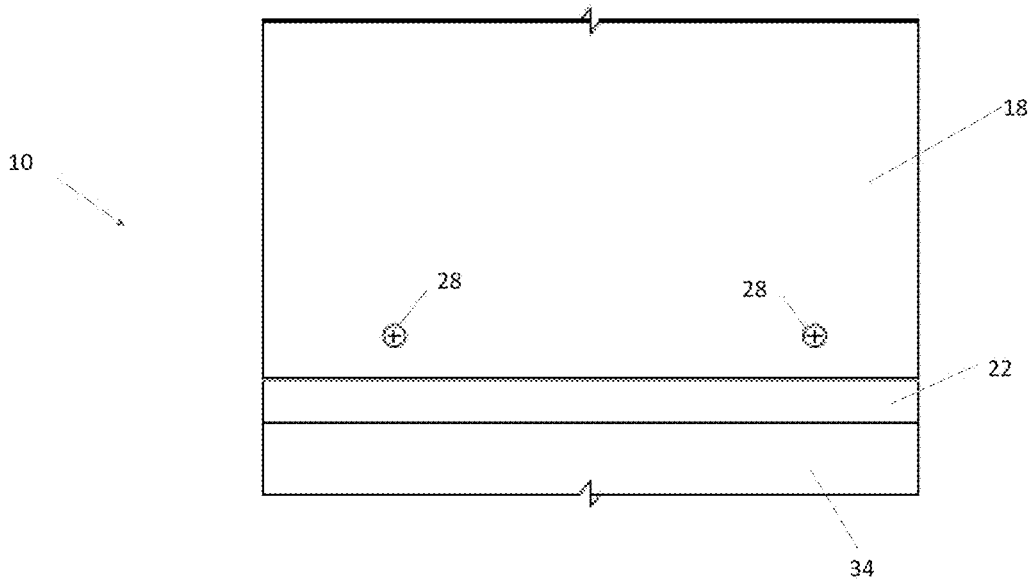
FIG. 20 is a top view of the embodiment of FIG. 15.
Figure 21:
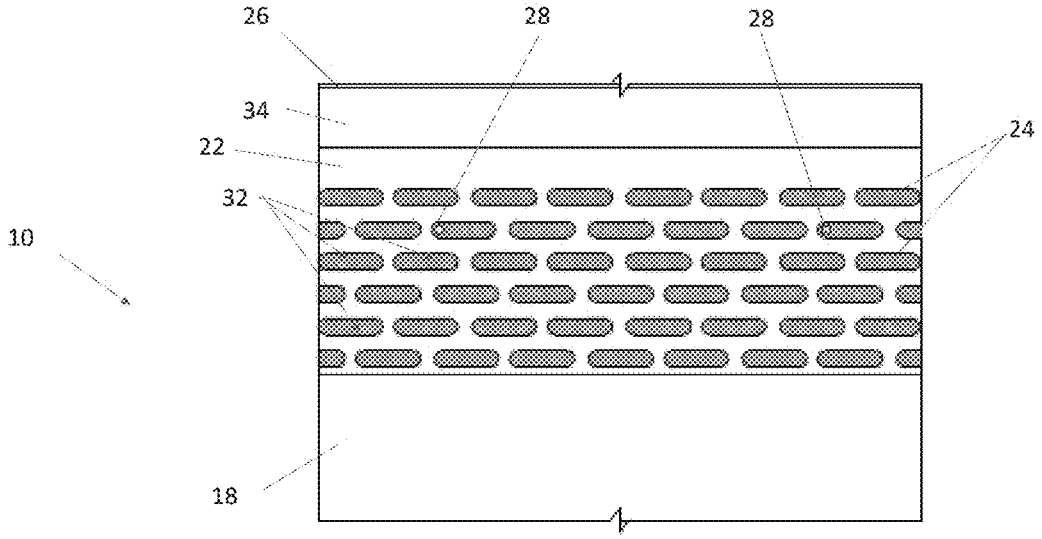
FIG. 21 is a bottom view of the embodiment of FIG. 15.

FIG. 8 is a right side sectional view of another exemplary embodiment of the present invention. This embodiment is similar to the embodiment shown and described with respect to FIGS. 1-7. However, in this embodiment, the angle B between the outer surface of the upper cover 18 and the outer surface of the attachment lip 14 may be relatively closer to 90 degrees as compared to angle A, thus resulting in a less steep pitch of the upper cover 18 and a lower mounting point for the attachment lip 14 and the fasteners 16. This embodiment may be used, for example but without limitation, where there is less distance between the upper edge of the gutter 12 and the lower edge of the roof 8. Again, it is contemplated that angle B may be any angle between 90 and 180 degrees.

FIG. 9 through FIG. 14 illustrate another exemplary embodiment of the present invention. This embodiment is similar to the embodiment shown and described with respect to FIG. 8 but utilizes an alternative attachment arrangement. In this embodiment, the gutter cover 10 is configured to extend over a portion of the roof 8. The upper cover 18 may extend at a downward angle that is substantially the same as the pitch of the roof 8. For example, but not to serve as a limitation, such an embodiment may be utilized where there is insufficient space between the roof 8 and the structure 6 to mount the gutter cover 10 using the attachment lip 14. Preferably, the gutter cover 10 is configured to extend beneath the shingles of a portion of the roof 8. This may be accomplished by removing the attachment lip 14 and extending the upper cover 18 a further distance.

The gutter cover 10 may be secured to the roof 8 simply by the frictional forces created by placing the upper cover 18 under the shingles of the roof 8. In other exemplary embodiments, the gutter cover 10 may be secured to the roof 8 using various attachment devices such as, but not limited to, nails, fasteners, adhesive, staples, or the like. Though this alternative attachment arrangement is shown and described with respect to FIG. 9-14, those having skill in the arts will recognize that this attachment arrangement may be utilized with any of the other embodiments shown or described herein.

FIG. 15 through FIG. 21 illustrate another exemplary embodiment of the present invention. This embodiment is similar to the embodiment shown and described with respect to FIGS. 1-7. However, in this embodiment, the angle C between the outer surface of the upper cover 18 and the outer surface of the attachment lip 14 may be substantially 90 degrees or thereabouts. In this way, the upper cover 18 may extend substantially parallel to the ground. Further, the folded section 20 and the covering section 22 may extend substantially parallel to the ground. However, such is not required, the folded section 20 and the covering section 22 may extend at a downward angle towards the ground as shown and described with respect to the previous embodiments.

This embodiment may be used, for example but without limitation, where there is very little or no distance between the upper edge of the gutter 12 and the lower edge of the roof 8. This embodiment may permit the upper edge of the attachment lip 14 to be located at or near substantially the same height as the upper edge of the gutter 12. In this way, the upper cover 18, the folded section 20, and the covering section 22 may be located below the upper lip of the gutter 12. Thus, in such embodiments the gutter cover 10 may additionally comprise a stepped section 34. The stepped section 34 may extend in a step shape from the covering section 22 to the connecting lip 26. More specifically, the stepped section 34 may extend vertically upward from the covering section 22 until reaching the upper edge of the gutter 12, where it then may extend horizontally along said upper edge of the gutter 12 until reaching the front edge of the gutter 12 where it then may extend vertically downward in order to secure the gutter cover 10 to the gutter 12 as previously described. In exemplary embodiments, the stepped section 34 extends at substantially 90 degree angles such that the vertical sections extend substantially perpendicular to the ground and the horizontal section extends substantially parallel to the ground. The stepped section 34 may be comprised of the same of different material than other components of the gutter cover 10.

In other exemplary embodiments, the gutter cover 10 may be mounted such that the upper cover 18 is substantially aligned with the upper surface of the gutter 12. In such embodiments, the stepped section 34 may not be required.

Even though this embodiment illustrates the angle C as substantially 90 degrees, debris filtered by the filtering mesh 24 and the apertures 32 may still be forced or encouraged to travel off the gutter 12 by external forces such as, but not limited to, water flow, wind, and the like. Regardless, the gutter cover 10 may make manual cleaning of the gutters 12 easier by providing a flat surface for the removal of debris instead of having to reach into the tight space of the gutter 12 which can be difficult or even impossible to reach without specialized tools.

Those having skill in the arts will recognize that the illustrated gutter 12, including its size, style, and shape, is merely exemplary. It is contemplated that the gutter cover 10 may be appropriately sized, shaped, and otherwise adapted to fit any size, style, and shape gutter 12.

Figure 22:
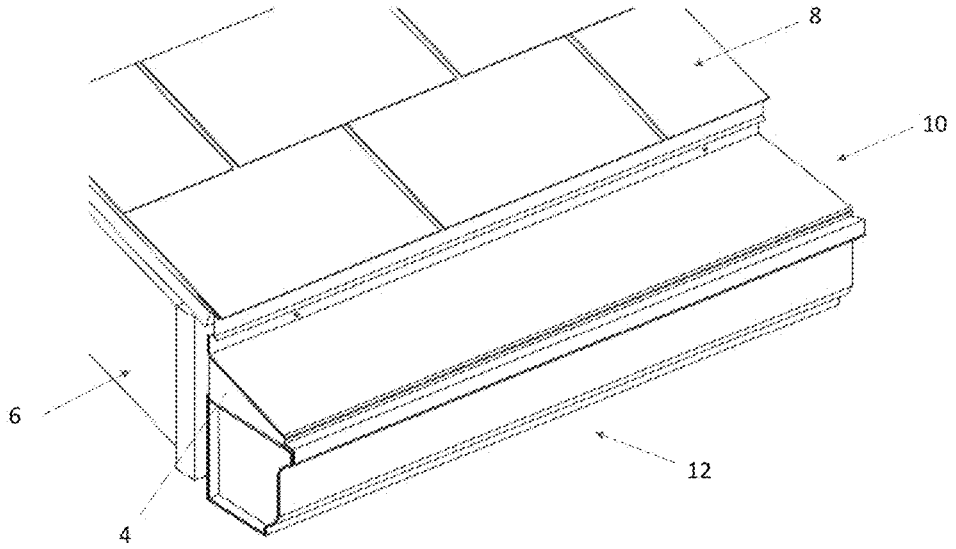
FIG. 22 is a front perspective view of another exemplary embodiment of the present invention illustrated as installed on a gutter.

FIG. 22 is a front perspective view of another exemplary embodiment of present invention where the gutter cover 10 further comprises one or more end caps 4. The end cap 4 may be located on an end of the gutter cover 10 and may be configured to substantially cover the area at the end of the gutter cover 10 between the upper cover 18 and the end of the gutter 12. The end cap 4 may be configured to keep debris, vermin, and other creatures out of the gutter 12. The end cap 4 may be fastened, adhered, press fit, or otherwise attached or bonded to the gutter cover 10 and/or the gutter 12. In other exemplary embodiments, the end cap 4 may be integrally formed as part of the gutter cover 10. The end cap 4 may be comprised of the same or different material as the rest of the gutter cover 10. In exemplary embodiments, the end cap 4 is configured to be located substantially flush with the end of the gutter 12. Any number of end caps 4 are contemplated to cover all ends of the gutter 12. It is notable that the end cap 4 may be utilized with any of the embodiments show or described herein.

Any embodiment of the present invention may include any of the optional or preferred features of the other embodiments of the present invention. The exemplary embodiments herein disclosed are not intended to be exhaustive or to unnecessarily limit the scope of the invention. The exemplary embodiments were chosen and described in order to explain the principles of the present invention so that others skilled in the art may practice the invention. Having shown and described exemplary embodiments of the present invention, those skilled in the art will realize that many variations and modifications may be made to the described invention. Many of those variations and modifications will provide the same result and fall within the spirit of the claimed invention. It is the intention, therefore, to limit the invention only as indicated by the scope of the claims.

What is claimed is:

1. A gutter cover for covering a gutter having an outer face and located on a structure having a roof comprising:

an attachment lip configured to be placed below the roof and substantially flush with the structure and be attached thereto;

an upper cover configured to extend at a downward angle from the attachment lip, wherein the angle between the upper cover and the attachment lip is between 90 and 180 degrees;

a folded section attached to said upper cover and configured to extend towards the attachment lip at a downward angle;

a covering section extending substantially parallel with and spaced apart from said folded section, wherein said covering section is configured to extend away from the attachment lip such that the cover section extends beyond the folded section;

a number of apertures in said covering section configured to allow water to pass therethrough;

a connecting lip configured to fit snugly to the outer face of the gutter; and a filtering mesh configured to allow water to pass therethrough while preventing debris from traveling therebeyond;

wherein the space between the covering section and the folded section is configured to receive the filtering mesh.

2. The gutter cover of claim 1 wherein:

the connecting lip extends from an end of the covering section located distal relative to said attachment lip.

3. The gutter cover of claim 1 wherein:

the filtering mesh is comprised of wire.

4. The gutter cover of claim 1 wherein:

the folded section is attached to the covering section.

5. The gutter cover of claim 1 further comprising:

a spacer configured to secure the folded section a relative distance from the covering section.

6. The gutter cover of claim 1 wherein:

the gutter cover is formed from a single piece of material.

7. The gutter cover of claim 6 wherein:

the gutter cover is comprised of plastic.

8. The gutter cover of claim 6 wherein:

the gutter cover is comprised of metal.

9. The gutter cover of claim 1 further comprising:

a number of fasteners configured to attach the attachment lip to the structure; and a number of holes located in the attachment lip configured to receive the fasteners.

10. The gutter cover of claim 1 further comprising:

a number of fasteners configured to attach the attachment lip to the structure; and a number of markings located on the attachment lip for suggesting positions for the fasteners.

11. The gutter cover of claim 1 further comprising:

an end cap configured to substantially cover the space between the upper cover and end of the gutter.

12. An apparatus for covering a gutter having a front edge and located on a structure having a roof comprising:

a lip configured to be placed substantially flush with the structure and receive a number of fasteners for attaching the lip to the structure;

a cover configured to extend from the lip;

a reversing section having an elongated U shape and comprising a number of apertures configured to allow water to pass into the gutter, wherein the reversing section extends from said cover towards the lip;

a wire mesh configured to be received within the reversing section and filter debris; and a connecting lip configured to fit snugly to the front edge of the gutter.

13. The apparatus of claim 12 wherein:

the cover is configured to extend at a downward angle.

14. The apparatus of claim 12 wherein:

the angle between the cover and the lip is substantially 90 degrees.

15. The apparatus of claim 14 further comprising:

a stepped section configured to extend vertically from the reversing section and horizontally a distance, wherein the connecting lip is attached to the stepped section.

16. The apparatus of claim 12 further comprising:

a threaded fastener extending through the reversing section.

17. The apparatus of claim 12 wherein:

the reversing section extends from said cover at a downward angle towards the structure when installed.

18. A system for coving a gutter having a front surface and located on a structure having a roof having a pitch comprising:

a cover that is configured to extend along a portion of the roof and away from the structure at a downward angle that is substantially the same as the pitch of the roof;

an elongated U shaped section defining an upper and a lower portion, wherein said elongated U shaped section is configured to extend from a distal end of said cover towards the structure at a downward angle, wherein the lower portion comprises a number of apertures configured to permit water to pass therethrough;

at least one spacer configured to secure the upper portion relative to the lower portion;

a lip configured to be secured against the front surface of the gutter; and a filtering mesh configured to be received within the elongated U shaped section, wherein the filtering mesh is configured to filter debris while allowing water to pass therethrough.

19. The system of claim 18 wherein:

the cover is configured to be secured beneath a layer of shingles on the roof.

* * * * *